US007963630B2

(12) United States Patent
Reisinger et al.

(10) Patent No.: US 7,963,630 B2
(45) Date of Patent: Jun. 21, 2011

(54) METHOD FOR SETTING THE RELATIVE SPEED BETWEEN A PRINT HEAD AND A RECORDING MEDIUM IN A THERMOTRANSFER PRINTING DEVICE

(75) Inventors: Frank Reisinger, Oranienburg (DE); Dirk Rosenau, Berlin (DE); Sabine Roth, Berlin (DE); Olaf Turner, Berlin (DE)

(73) Assignee: Francotyp-Postalia GmbH (DE)

( * ) Notice: Subject to any disclaimer, the term of this patent is extended or adjusted under 35 U.S.C. 154(b) by 601 days.

(21) Appl. No.: 11/949,909

(22) Filed: Dec. 4, 2007

(65) Prior Publication Data

US 2008/0145085 A1 Jun. 19, 2008

(30) Foreign Application Priority Data

Dec. 4, 2006 (DE) ..... 10 2006 057 374

(51) Int. Cl.
*B41J 2/165* (2006.01)
*G03G 15/20* (2006.01)

(52) U.S. Cl. ..... 347/26; 347/21; 347/23; 399/68

(58) Field of Classification Search ..... None
See application file for complete search history.

(56) References Cited

U.S. PATENT DOCUMENTS

| | | | | |
|---|---|---|---|---|
| 5,448,283 | A | 9/1995 | Takeuchi | |
| 6,057,870 | A * | 5/2000 | Monnier et al. | 347/171 |
| 2002/0041322 | A1 | 4/2002 | Miyoshi et al. | |

FOREIGN PATENT DOCUMENTS

| | | |
|---|---|---|
| GB | 2 411 151 | 8/2005 |
| WO | WO 2004/091915 | 10/2004 |

* cited by examiner

*Primary Examiner* — Stephen D Meier
*Assistant Examiner* — Alexander C Witkowski
(74) *Attorney, Agent, or Firm* — Schiff Hardin LLP

(57) ABSTRACT

In a method and thermotransfer printing device for setting the speed of a relative movement between the print head and a recording medium during a printing procedure in the thermotransfer printing device, in particular for setting the transport speed of a mail piece in a thermotransfer printing franking machine, the heat energies required for the generation of a predeterminable print image are calculated for the individual heating elements of the print head from start value that has been established for the desired speed. It is subsequently computationally checked whether the respectively calculated heat energy can be emitted at the respective heating element in a first time interval predetermined by the start value of the desired speed and a predeterminable remaining time. If so, a printing procedure follows in which the beginning of the printing procedure ensues using the end value of the desired speed.

20 Claims, 2 Drawing Sheets

METHOD FOR SETTING THE RELATIVE SPEED BETWEEN A PRINT HEAD AND A RECORDING MEDIUM IN A THERMOTRANSFER PRINTING DEVICE

BACKGROUND OF THE INVENTION

1. Field of the Invention

The invention concerns a method for setting the speed of a relative movement between a print head and a recording medium during a printing process in a thermotransfer printing device, in particular for setting the transport speed of a mail piece in a thermotransfer printing franking machine. The invention also concerns a thermotransfer printing device.

2. Description of the Prior Art

Thermotransfer printing technology has been known for some years and has proven to be of value in the field of label and ticket printing as well as in franking of mail using EDP (electronic data processing).

Configurations known as 2D barcodes (data matrix symbol) which, among other things, include data regarding the shipped product, the postage account, and the recipient address, are in particular used in the latter cited application. The 2D barcode itself is executed as a printed, rectangular region that is subdivided into rectangular (mostly square) fields (known as modules). This region includes solid lines and lines with light and dark modules in alternation for recognition and classification of the symbol. The usable information is located between the recognition lines in the form of light or dark modules that are composed of a number of pixels (for example 6×6 pixels). The 2D barcode additionally includes redundant data, such that up to 25% of the errors in the individual modules can be automatically corrected by suitable correction algorithms when, for example, parts of the 2D barcode have been covered over or become unreadable.

In the franking of mail by a thermotransfer printing, an ink ribbon is located between the letter and a print head that has a large number of heating elements arranged in a column perpendicular to the letter travel direction. When a heating element is activated and heated, the ink layer in the ink ribbon melts and is transferred to the paper surface of the letter. In order to enable a two-dimensional printing of the letter, the ink ribbon moves below the print head together with the letter. The transport speed is determined by an encoder, with the encoder wheel resting on the ink ribbon, for example.

The machine readability, especially of 2D barcodes with very small module sizes (for example 0.5 mm×0.5 mm) decisively depends on the print quality of the thermotransfer printing device. Significant factors for the print quality are a uniform size of the modules both in the transport direction and in the print column direction as well as the uniform areal coverage across the 2D barcode. Fluctuations in the transport speed can cause both compressions and expansions in the printout of the data matrix symbol that are known as "ripples". The transport speed is influenced by production tolerances of the thermotransfer printing device (for example a franking machine) that can change during the lifespan of the device. For a thermotransfer printing device fashioned as a franking machine, the transport speed also depends on the thickness of the letter to be franked. Given the same drive control, thick and heavy letters are thus transported slower (due to inertia or as a consequence of higher friction) than thin, light letters.

SUMMARY OF THE INVENTION

An object of the present invention is to provide a method for setting the speed of a relative movement between a print head and a recording medium during a printing procedure in a thermotransfer printing device that enables printing with constant speed and high quality. The influences of manufacturing tolerances and wear of the thermotransfer printing device employed should be minimized with the method. In the case of a stationary print head and a recording medium moved along the print head, the influence of the thickness and the weight of the recording medium to be printed on the transport speed should also be minimized.

The object is achieved in accordance with the invention BY a method for setting and regulation of the relative speed between a print head and a recording medium in a thermotransfer printing device, in particular for regulation of the transport speed of a mail piece in a thermotransfer printing franking machine, wherein a start value for a desired speed of the relative movement is established, and for the individual heating elements of the print head, the heat energies required for the generation of a predeterminable print image are calculated dependent on the start value of the desired speed. A computational check is made as to whether the respectively calculated heat energy can be emitted at the respective heating element in a first time interval that is predetermined by the start value of the desired speed and a predeterminable remaining time. An end value of the desired speed is then established with a reduction of the desired speed ensuing if at least one of the heat energies cannot be emitted in the first time interval and/or an increase of the desired speed ensuing if all heat energies can be emitted in a predeterminable shorter second time interval.

A printing procedure ensues in which the beginning of the printing procedure uses the end value of the desired speed.

The inventive method causes the thermotransfer printing to ensue with a speed that enables an optimal print quality. In addition, the speed reserve that is to be retained for compensation of the aforementioned tolerance problems relative to the maximum possible printing speed according to the printing technology can be minimized. The effective operating speed thus can be distinctly increased.

In the method, a start value for a desired speed of the relative movement is initially established. This is based on the experience of a trained operator or on initial factory settings. The heat energies required for the generation of a predeterminable print image are subsequently calculated for the individual heating elements for the established desired speed. If a computational check shows that, due to a desired speed selected too high, at least one of the calculated heat energies cannot be entirely emitted at the appertaining heating element in a first time interval that is predetermined by the start value of the desired speed and a predeterminable remaining time, the establishment of the end value of the desired speed causes the desired speed to be reduced. The required heat energies can then be calculated again for the reduced desired speed to check the settings. Additionally or alternatively, if all heat energies can even be entirely emitted at the heating elements in a predeterminable shorter second time interval (this means that a portion of this time interval remains unused and the heating elements cool off again in this portion of the time interval, which leads to a decrease of the print quality), the desired speed can be increased. In this case the required energies can then be calculated again to check the settings.

According to an embodiment of the invention, for the case of the print head heating up by a specific temperature interval in the course of the operation of the printing device, a detection of the print head temperature ensues, and the establishment step is repeated in the manner described above with a change of the print head temperature by a predeterminable value.

According to a further embodiment of the invention, a remaining non-zero time in which momentary speed fluctuations can be compensated is predetermined in the computational checking of the heat energies.

The correction of the desired speed can be further refined in order to further optimize the desired speed with respect to an error-free, readable print image in. It is thus possible to repeat the establishment step at least once using the end value of the desired speed as a start value of the desired speed, so that an even better adaptation of the desired speed to the heating properties of the heating elements is achieved.

The computational effort for correction of the desired speed can be significantly simplified by establishing a predeterminable number of values (in particular only two values) for the desired speed in the establishment step.

After a correction as needed, the printing step can now be begun.

In a further embodiment of the invention, a regulation of the printing is undertaken using a determination of the difference between the end value of the desired speed and the real speed between the print head and the recording medium, and if applicable a convergence of the real speed to the end value of the desired speed ensues. This regulation reduces the influences of the manufacturing-based idiosyncrasies of the employed thermotransfer printing device (which change over the lifespan of the device) and (in the case of a stationary print head) the influence of recording media of different thicknesses and weights, or the quality of the print image, such that in particular a 2D barcode printed on the mail pieces can be correctly read by a machine at any time.

For the regulation, the real speed (i.e. the actual relative speed between print head and recording medium) is thus determined. For example, this can ensue with an encoder, with the time between two encoder pulses being measured. The difference between the measured real speed and the end value of the desired speed is then determined. The real speed is adapted to the end value of the desired speed via a corresponding regulation corresponding to the determined difference. For this purpose, an appropriate correction value of the control value for the drive is determined as a regulatory control value.

In another embodiment of the inventive method, in the printing procedure a first correction value of the control value for the drive is determined from the difference between the end value of the desired speed and the end value of the real speed, and the real speed is made to converge on the end value of the desired speed using a fraction of the first correction value. This ensures that the real speed is not adapted too quickly to the desired speed in order to avoid a too-severe correction which could cause a fluctuation of the regulation.

The adaptation of the real speed to the end value of the desired speed advantageously ensues in steps. It can be appropriate to determine the difference between the respective current real speed and the end value of the desired speed and to converge the control value for the drive on the end value of the desired speed in turn using a fraction of the new second correction value resulting from the difference between the end value of the desired speed and the respective current real speed. In each case an iterative convergence on an optimal speed is achieved.

In the case of a real speed that is initially too low, the fraction can be approximately 2% of the respective correction value. in the case of a stationary print head and moving recording media (as this is most often the case in a franking machine, for example), such a slight increase of the real speed is effective to prevent lighter recording medium, that follow heavy and slow recording media for which the real speed was determined, from being printed with a speed that is too high and that impairs the print quality such that, in the case of a 2D barcode to be printed, the readability thereof would no longer be ensured. In contrast to this, a real speed that is too low relative to the desired speed is normally unproblematical for the print quality (and thus the readability) of a 2D barcode.

In the case of a real speed that is initially too high, the fraction can be approximately 75% of the respective correction value. A reaction to a printing speed that is too high can be done sufficiently quickly through this correspondingly significant decrease of the real speed. It is also ensured that the speed is updated with a hysteresis in order to prevent fluctuation of the regulation.

According to a further embodiment of the invention, an offset is determined and stored using the respective, last-determined first correction value in the thermotransfer device, and this offset is used to establish a start value for the control of a drive unit that generates the relative movement, when the same printing speed is again used. Device-specific deviations between the desired speed and the real speed that, for example, are due to manufacturing tolerances of the printing device, can thereby be compensated in a manner specific to the device, such that at the next start-up of the device, or upon the next recording medium to be printed, the printing can be begun with a speed that is, with high probability, suitable. In the course of the aging process of the device the offset can thus be suitably adapted to the changing mechanical state of the device.

In many thermotransfer printing devices the drive unit is controlled using pulse width-modulated control signals (PMW values). A value corresponding to the end value of the desired speed can be set as a PWM value at the drive unit at the beginning of the printing process, with the actual PWM value being determined using an empirically determined linear equation and the stored offset.

The above object also is achieved by a thermotransfer printing device in accordance with the present invention that implements the above-described method and all embodiments thereof.

DESCRIPTION OF THE PREFERRED EMBODIMENTS

Figure 1:
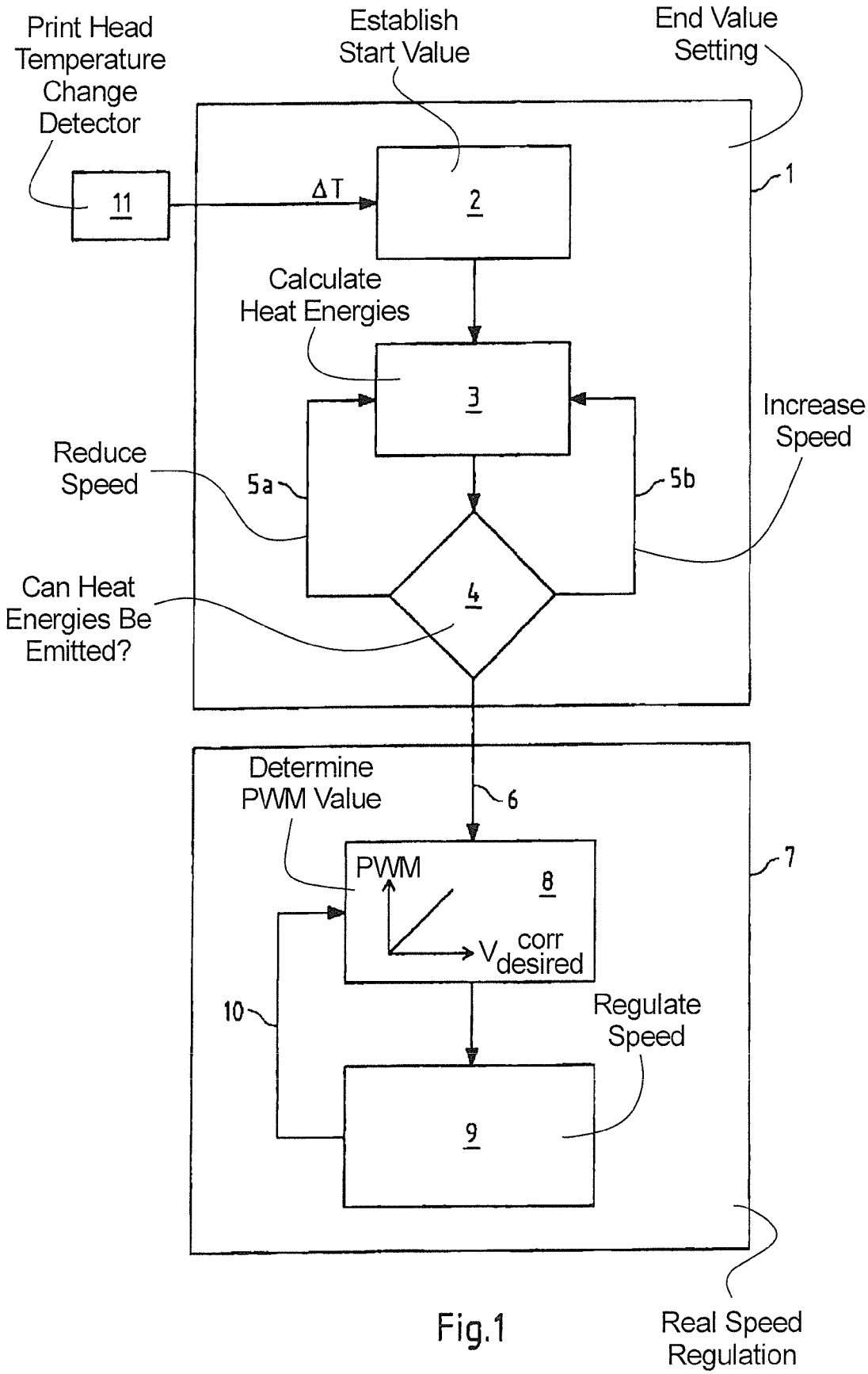
FIG. 1 is a flowchart for an embodiment of the inventive method for setting and regulation of the relative speed between a print head and a recording medium.

A workflow of the inventive method for setting the relative speed between a print head and a recording medium in a thermotransfer printing device is presented in FIG. 1.

As shown in FIG. 1, the method according to the exemplary embodiment can essentially be divided into two basic steps, namely the setting of the end value of a desired speed in the basic step 1 and the regulation of the real speed to the end value of the desired speed in the basic step 7.

In the basic step 1, in a first step 2 a start value for the desired speed is initially established, this start value being based on the experience of an experienced operator or on initial factory settings. This start value is typically read from a memory or is calculated from values stored therein according to a predetermined algorithm.

In a following step 3, the heat energies required for a predetermined print image are then calculated for the individual heating elements of the print head dependent on the start value of the desired speed that was set in step 2.

In a step 4 it is computationally checked whether the calculated heat energies can respectively be emitted at the heating elements of the print head in a time interval that is predetermined by the start value of the desired speed and a predeterminable remaining time. If the remaining time is selected not equal to zero, (i.e., the predetermined time interval being shorter by the remaining time than the time interval resulting from the start value), the effects of temporary speed fluctuations of the drive thus can at least be reduced.

If this is the case, the start value can be directly relayed as an end value of the desired speed (arrow 6) in order to calculate a corresponding PWM value for the transport motor from the end value of the desired speed.

If the computational check in step 4 shows that, due to the start value of the desired speed having been selected too high, one of the calculated heat energies cannot be entirely emitted at the appertaining heating element in a time interval determined by the start value of the desired speed and the remaining time, the value of the desired speed is thus reduced (arrow 5*a*) and the required heat energies are calculated with this reduced value of the desired speed as a start value in a new step 3 to be executed.

If all heat energies can respectively be emitted in a shorter time interval than the time interval defined by the initially established start value of the desired speed and the remaining time, the value of the desired speed is increased (arrow 5*b*). The required heat energies are then calculated again with this increased value of the desired speed as a start value. The calculation and checking of the heat energies for the corrected start values of the desired speed can advantageously be repeated multiple times, for example until the longest time interval calculated for the emission of the calculated heat energies has converged with a predeterminable tolerance on the value, which yields the time interval resulting from the respective start value minus the remaining time. A termination of this iterative process thus consequently ensues when a sufficient convergence on an optimal value is achieved. An optimal convergence of the desired speed on the heating properties of the heating elements can herewith be achieved.

The end value ultimately established for the desired speed in the process (which process is possibly run through multiple times) is passed to the control and regulation system 18 of the transport motor 13 of the thermotransfer printing device. A PWM value for the transport motor 13 is initially determined in step 8 from the end value of the desired speed using an empirically determined calibration curve (for example a calibration line) and is set at the transport motor 13. The printing procedure is then begun and the transport speed is measured via an encoder wheel 17 or 17'.

The difference between the desired speed and the real speed is determined in the regulation step 9 and a corresponding first PWM correction value is determined. In an adaption step, the real speed is adapted to the desired speed using a fraction of this first correction value. If the real speed measured via the encoder lies below the desired speed, the real speed is increased, wherein the current PWM value is advantageously increased by 2% of the previously determined PWM correction value. It is thereby ensured that the real speed is not adapted too quickly to the desired speed in order to avoid a correction that is too severe, which would cause a fluctuation of the regulation.

If the measured real speed lies above the desired speed, the real speed is likewise decreased using a fraction of the previously determined PWM correction value. The fraction advantageously lies at 75% of the PWM correction value, such that a printing speed that is too high can be reacted to sufficiently quickly in order to avoid the printing of the 2D barcode with too high a speed (which would impair its readability).

The adaptation of the real speed to the desired speed advantageously ensues in steps in step 9, with the difference between the respective current real speed and the end value of the desired speed being determined and the current real speed in turn being adapted to the end value of the desired speed using a fraction of the new PWM correction value resulting from the difference. In the case of a current real speed that is too low, this fraction is again advantageously 2%; in the case of a corrected real speed that is too high, this fraction is again advantageously 75%. An iterative convergence on an optimal transport speed is thus achieved.

In other variants of the invention it the adaptation of the real speed to the desired speed in the step 9 ensues only in a predeterminable number of adaptation steps per imprint to be generated. The adaptation of the real speed to the desired speed can in particular also ensue in only a single adaptation step per imprint. The step-by-step adaptation consequently then possibly ensues only over a number of successive imprints or, respectively, letters.

Among other things, in the processing of mixed mail this has the advantage that individual, distinctly thicker (and thus more slowly transported) letters do not lead to an immediate, severe upward correction of the real speed which, for subsequent thinner letters, would immediately result in a severe correction of the real speed again.

The workflow described above, including the adaptation of the real speed to the desired speed in the step 9, advantageously ensues so quickly that, for a conventional franking imprint with a clear text/graphic portion preceding the 2D barcode, it is already comprised during the printing of the clear text/graphic portion, but at the latest with the beginning of the printing of the 2D barcode, such that in any case the good readability of the 2D barcode is ensured.

In FIG. 1, arrow 10 indicates that the first PWM correction value is used to determine an offset that is stored in the thermotransfer printing franking machine. In the first pass the first PWM correction value is thereby simply stored as an offset while in the subsequent passes the respective new PWM correction value is only used for correction of the offset. The offset is employed for the determination of the PWM value at the beginning of the printing procedure, which determination ensues using the calibration curve. It is thus possible to compensate for device-specific deviations between desired speed and real speed that, for example, are done to manufacturing imprecisions of the printing device, such that at the next start-up of the franking machine, or at the next imprint to be generated, the printing can be immediately begun at a (with high probability) suitable speed. The offset thus can be adapted to the changing mechanical state of the machine in the course of the aging process of the franking machine.

When, during the operation of the franking machine, the temperature of the print head changes (normally increases), a new regulation of the desired speed is effected in step 2 in the event that the temperature increase exceeds a specific amount. This is indicated by the block 11 in FIG. 1.

Figure 2:
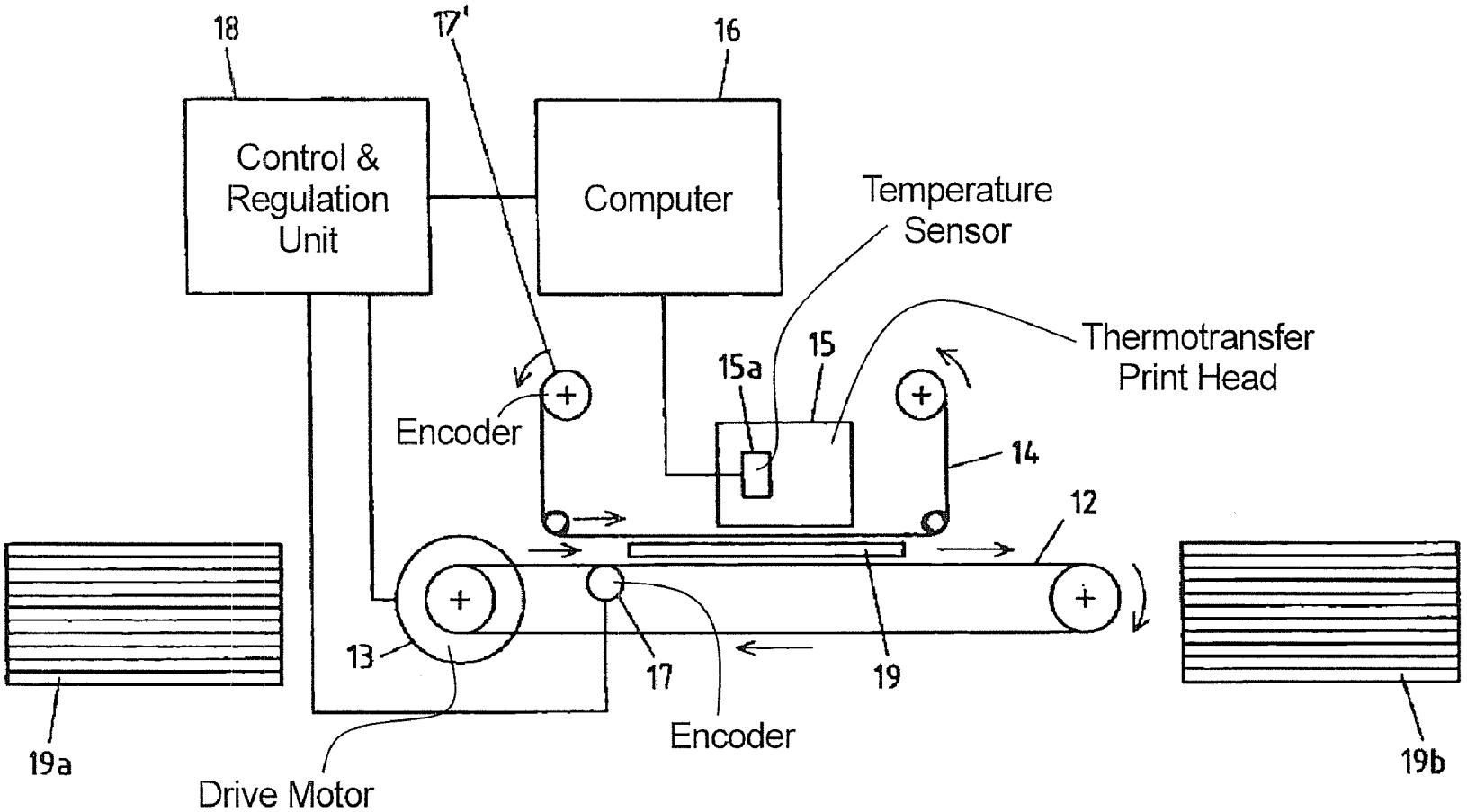
FIG. 2 is a simplified schematic illustration of an embodiment of a franking machine for printing 2D barcodes on letter envelopes in accordance with the invention.

A franking machine operating according to the thermotransfer printing method is shown in schematic form in FIG. 2. It has a transport belt 12 as a movement unit which is set into motion by a drive motor 13. The franking machine also has an ink ribbon 14 as well as a thermotransfer print head 15 that has in a known manner, a number of heating elements (not shown) arranged in a column. The temperature of the print head is continuously measured by a temperature sensor 15*a* and is relayed to a computer 16. The franking machine also has an encoder wheel 17 that continuously measures the actual real speed of the transport belt 12 and transfers the measurement values to a control and regulation unit 18.

It is understood that the encoder wheel can be arranged at a different point in other variants of the invention. An encoder wheel 17' coupled with the ink ribbon 14 can be provided in order to detect its movement, this movement ensuing essentially without slippage relative to the letter 19 and therefore also providing reliable information regarding the speed of the letter 19.

In the operation of the franking machine a letter 19 is placed on the transport belt 12 from a letter stack of letters of different thicknesses by a transfer unit (not shown). The drive motor 13 driving the transport belt 12 is controlled via PWM signals from the control and regulation unit 18, the PWM signals corresponding to the desired speed determined in the computer 16 according to the manner described above. The drive motor 13 moves the ink ribbon 14 running between print head 15 and the letter along with the letter 19 below the print head 15.

In the course of the printing procedure the letter is printed by the print head with a 2D barcode as well as further information. In the course of the printing procedure the regions of the print image that are non-critical with regard to their readability are initially printed on the letter envelope, with the real speed measured via the encoder wheel 17 or, respectively, 17' being adapted to the end value of the desired speed by the control and regulation unit 18 in the manner described in the preceding. The adaptation ensues quickly such that the optimal speed achieved by the iterative adaptation process is already set at the transport motor upon printing of the 2D barcode. The 2D barcode is thus printed with optimal print quality and the letter is placed on the stack 19*b* by the transport belt 12 after the printing procedure.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for setting a speed of relative movement between a thermotransfer print head and a recording medium during a printing procedure, said thermotransfer print head comprising a plurality of individually activatable heating elements, said method comprising the steps of:

in a determination step, establishing a start value for a desired speed of said relative movement and, for the individual heating elements of the print head, automatically calculating, in a computerized processor, respective heat energies required to generate a predetermined print image dependent on said start value, and computationally checking in said computerized processor whether the respectively calculated heat energies can be emitted by the respective heating elements in a first time interval that is predetermined by said start value and a predetermined remaining time, and establishing an end value of the desired speed, said end value being determined in said computerized processor using a reduction of the desired speed if at least one of the respective heat energies cannot be emitted in the first time interval, and said end value being determined in said computerized processor using an increase of the desired speed if all of the respective heat energies can be emitted in a predetermined second time interval that is shorter than said first time interval; and in a printing step, executing a printing procedure that starts using said end value of the desired speed.

2. A method as claimed in claim 1 comprising detecting a temperature of said print head and repeating said establishing step upon a change of the temperature of the print head by a predetermined amount.

3. A method as claimed in claim 1 comprising employing a non-zero time duration as said remaining time in said computational checking, to compensate for momentary fluctuations of said transport speed.

4. A method as claimed in claim 1 comprising repeating said establishing step at least once, in a repeated establishing step, using the end value of the desired speed as the start value of the desired speed in the repeated establishing step.

5. A method as claimed in claim 1 comprising, in said establishing step, establishing a predetermined number of end values for said desired speed.

6. A method as claimed in claim 1 comprising regulating said printing step by determining a difference between the end value of the desired speed and a real speed between the print head and the recording medium and causing said real speed to converge on said end value of said desired speed.

7. A method as claimed in claim 6 comprising determining said real speed using an encoder.

8. A method as claimed in claim 6 comprising determining a correction value from said difference between the end value of the desired speed and the real speed, and causing the real speed to converge on the end value of the desired speed using a fraction of said correction value.

9. A method as claimed in claim 8 wherein said fraction is approximately 2% of said correction value if said real speed is too low, and is approximately 75% of said correction value if said real speed is too high.

10. A method as claimed in claim 8 wherein said correction value is a first correction value, and converging the real speed on the end value of the desired speed in iterative steps, and in each of said iterative steps, determining a second correction value from the difference between the real speed in that iterative step and the end value of the desired speed, and converging the end value of the desired speed using a fraction of the second correction value.

11. A method as claimed in claim 10 wherein said fraction is approximately 2% of said second correction value if said real speed is too low, and is approximately 75% of said second correction value if said real speed is too high.

12. A method as claimed in claim 8 comprising determining an offset using a last-determined correction value and storing said offset and, upon a repetition of said printing step at said desired speed, using the stored offset to establish said start value in the establishing step for the repetition of said printing step.

13. A method as claimed in claim 12 comprising producing said transport speed with a drive unit controlled by pulse width modulation.

14. A method as claimed in claim 13 comprising at said drive unit, setting a pulse width modulation value corresponding to the end value of the drive speed at the beginning of the printing procedure, by determining said PWM value using a linear equation and said stored offset.

15. A thermotransfer printing device that sets a speed of relative movement between a thermotransfer print head and a recording medium during a printing procedure, comprising:

a thermotransfer print head comprising a plurality of individually activatable heating elements;

a transport unit that produces a relative movement between said thermotransfer print head and a recording medium;

a computer configured to, in a determination step, establish a start value for a desired speed of said relative movement and, for the individual heating elements of the print head, calculate respective heat energies required to generate a predetermined print image dependent on said start value, and computationally check whether the respectively calculated heat energies can be emitted by the respective heating elements in a first time interval that is predetermined by said start value and a predetermined remaining time, and establish an end value of the desired speed, said end value being determined using a reduction of the desired speed if at least one of the respective heat energies cannot be emitted in the first time interval, and said end value being determined using an increase of the desired speed if all of the respective heat energies can be emitted in a predetermined second time interval that is shorter than said first time interval, and, in a printing step, to operate said thermotransfer print head to execute a printing procedure that starts using said end value of the desired speed to print indicia on said medium.

16. A thermotransfer printing device as claimed in claim 15 wherein said movement unit is a transport belt.

17. A thermotransfer printing device as claimed in claim 15 comprising a measurement unit that measures a real speed of said transport speed and emits a real speed signal corresponding thereto, and wherein said control unit is supplied with said real speed signal and is configured to regulate said transport speed dependent on said real speed signal.

18. A thermotransfer printing device as claimed in claim 17 wherein said measurement device comprises an encoder.

19. A thermotransfer printing device as claimed in claim 15 comprising a temperature sensor at said thermotransfer print head that measures a temperature of the thermotransfer print head, and wherein said control unit is configured to repeat said establishment of said end value upon a detected change of the temperature of said thermotransfer print head by a predetermined amount.

20. A thermotransfer printing device as claimed in claim 15 wherein said movement unit is configured to transport letters as said medium, and wherein said control unit is configured to operate said thermotransfer print device to produce said indicia forming a franking imprint comprising a 2D barcode in said letters.

* * * * *